US009609915B2

(12) United States Patent
Rushbrook et al.

(10) Patent No.: US 9,609,915 B2
(45) Date of Patent: Apr. 4, 2017

(54) OUTSOLE OF A FOOTWEAR ARTICLE, HAVING FIN TRACTION ELEMENTS

(71) Applicant: NIKE, Inc., Beaverton, OR (US)

(72) Inventors: Thomas J. Rushbrook, Portland, OR (US); Brooke P. Rapf, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 270 days.

(21) Appl. No.: 13/758,504

(22) Filed: Feb. 4, 2013

(65) Prior Publication Data

US 2014/0215853 A1 Aug. 7, 2014

(51) Int. Cl.

| | |
|---|---|
| ***A43B 13/22*** | (2006.01) |
| ***A43B 13/14*** | (2006.01) |
| ***A43C 15/16*** | (2006.01) |
| ***A43B 5/00*** | (2006.01) |

(52) U.S. Cl.

CPC ..... *A43B 13/22* (2013.01); *A43B 5/001* (2013.01); *A43B 13/141* (2013.01); *A43B 13/223* (2013.01); *A43C 15/162* (2013.01)

(58) Field of Classification Search

CPC ..... A43B 5/00; A43B 5/001; A43B 13/22; A43B 13/24; A43B 13/26; A43B 13/14; A43B 13/16; A43B 13/181; A43B 13/141; A43C 15/162

USPC ..... 36/102, 59 C, 127, 134, 103, 88, 59 R, 36/25 R, 31, 128; D2/962, 954

See application file for complete search history.

(56) References Cited

U.S. PATENT DOCUMENTS

| | | | | |
|---|---|---|---|---|
| D15,185 | S | 8/1884 | Brooks | |
| 1,087,212 | A | 2/1914 | Caldwell | |
| 1,355,827 | A | 10/1920 | Finneran | |
| 1,528,782 | A | 11/1924 | Perry | |
| 1,736,576 | A | 11/1929 | Cable | |
| D81,917 | S | 9/1930 | Burchfield | |
| 1,876,195 | A | 9/1932 | Youmans | |
| 2,179,942 | A * | 11/1939 | Lyne | A43B 5/001 36/127 |
| D171,130 | S | 12/1953 | Gruner | |
| D201,865 | S | 8/1965 | Bingham, Jr. et al. | |
| 3,328,901 | A | 7/1967 | Strickland | |
| 3,341,952 | A | 9/1967 | Dassler | |

(Continued)

FOREIGN PATENT DOCUMENTS

| | | |
|---|---|---|
| DE | 3135347 | 3/1983 |
| DE | 3706069 | 9/1988 |

(Continued)

OTHER PUBLICATIONS

Pending U.S. Appl. No. 13/234,182, filed Sep. 16, 2011.

(Continued)

*Primary Examiner* — Anna Kinsaul
*Assistant Examiner* — Jocelyn Wu
(74) *Attorney, Agent, or Firm* — Banner & Witcoff, Ltd.

(57) ABSTRACT

A sole structure can include an outsole with flexure zones that allow relative movement between regions of the outsole bottom surface that are separated or defined by the flexure zones. Such relative movement, together with selected traction elements or combinations of traction elements within the regions, act to provide the needed traction and stability for a number of motions that normally accompany a given activity such as golf.

28 Claims, 5 Drawing Sheets

(56) References Cited

U.S. PATENT DOCUMENTS

D213,416 S 3/1969 Dittmar et al.
D219,503 S 12/1970 Vietas
3,597,863 A 8/1971 Austin et al.
3,656,245 A 4/1972 Wilson
4,060,917 A 12/1977 Canale
4,096,649 A 6/1978 Saurwein
4,107,858 A 8/1978 Bowerman et al.
D255,957 S 7/1980 Pasquier
4,245,406 A 1/1981 Landay et al.
4,315,374 A 2/1982 Sneeringer
4,335,529 A * 6/1982 Badalamenti ..... A43B 5/00 36/114
4,335,530 A 6/1982 Stubblefield
4,347,674 A 9/1982 George
4,392,312 A 7/1983 Crowley et al.
D271,159 S 11/1983 Muller-Feigelstock
D272,200 S 1/1984 Autry et al.
D272,772 S 2/1984 Kohno
4,454,662 A 6/1984 Stubblefield
D278,759 S 5/1985 Norton et al.
4,574,498 A 3/1986 Norton et al.
4,586,274 A 5/1986 Blair
D287,662 S 1/1987 Tonkel
4,689,901 A 9/1987 Ihlenburg
4,698,923 A 10/1987 Arff
D294,655 S 3/1988 Heyes
D295,231 S 4/1988 Heyes
4,858,343 A 8/1989 Flemming
5,025,573 A 6/1991 Giese et al.
5,174,049 A 12/1992 Flemming
5,201,126 A 4/1993 Tanel
D339,459 S 9/1993 Yoshikawa et al.
5,335,429 A 8/1994 Hansen
5,406,723 A 4/1995 Okajima
5,452,526 A 9/1995 Collins
5,461,801 A 10/1995 Anderton
5,473,827 A 12/1995 Barre et al.
D368,156 S 3/1996 Longbottom et al.
D368,360 S 4/1996 Wolfe
D369,672 S 5/1996 Tanaka et al.
5,524,364 A 6/1996 Cole et al.
5,555,650 A 9/1996 Longbottom et al.
5,572,807 A 11/1996 Kelly et al.
5,617,653 A 4/1997 Walker et al.
5,678,328 A 10/1997 Schmidt et al.
D387,892 S 12/1997 Briant
D389,298 S 1/1998 Briant
5,709,954 A 1/1998 Lyden et al.
D394,943 S 6/1998 Campbell et al.
5,761,832 A 6/1998 George
5,832,636 A 11/1998 Lyden et al.
D402,449 S 12/1998 Robinson
D403,147 S * 12/1998 Erickson ..... D2/954
D406,938 S * 3/1999 Lin ..... D2/954
5,943,794 A 8/1999 Gelsomini
5,987,783 A 11/1999 Allen et al.
6,016,613 A 1/2000 Campbell et al.
D421,833 S 3/2000 Fallon
6,035,559 A 3/2000 Freed et al.
D427,754 S 7/2000 Portaud
6,101,746 A 8/2000 Evans
6,145,221 A 11/2000 Hockerson
6,161,315 A 12/2000 Dalton
D437,108 S 2/2001 Peabody
D437,989 S 2/2001 Cass
6,199,303 B1 3/2001 Luthi et al.
6,231,946 B1 5/2001 Brown, Jr. et al.
D443,407 S 6/2001 Patterson
6,289,611 B1 * 9/2001 Patterson et al. ..... 36/127
6,354,022 B2 3/2002 Gelsomini
D461,297 S 8/2002 Lancon
D477,905 S 8/2003 Adams et al.
D478,714 S 8/2003 Recchi
6,615,512 B2 9/2003 Sink
6,708,426 B2 3/2004 Erickson
6,708,427 B2 3/2004 Sussmann et al.
6,725,574 B2 4/2004 Hokkirigawa et al.
6,754,984 B2 6/2004 Schaudt et al.
6,817,117 B1 11/2004 Campbell
6,857,205 B1 2/2005 Fusco
6,892,479 B2 5/2005 Auger et al.
6,935,055 B2 8/2005 Oorei
6,941,684 B2 9/2005 Auger et al.
6,954,998 B1 10/2005 Lussier
6,968,637 B1 11/2005 Johnson
6,973,745 B2 12/2005 Mills et al.
6,973,746 B2 12/2005 Auger et al.
7,007,410 B2 3/2006 Auger et al.
D518,280 S * 4/2006 Matis et al. ..... D2/957
D525,416 S 7/2006 Auger et al.
7,143,530 B2 12/2006 Hudson et al.
7,181,868 B2 2/2007 Auger et al.
7,204,044 B2 4/2007 Hoffer et al.
D571,092 S 6/2008 Norton
D571,542 S 6/2008 Wilken
D573,779 S 7/2008 Stauffer
7,401,418 B2 7/2008 Wyszynski et al.
D575,041 S 8/2008 Wilken
7,406,781 B2 8/2008 Scholz
D578,280 S 10/2008 Wilken
7,441,350 B2 10/2008 Auger et al.
D579,641 S 11/2008 Erickson
D581,146 S * 11/2008 Lane, III ..... D2/954
7,536,810 B2 5/2009 Jau et al.
7,591,085 B2 9/2009 Haugltn
D607,635 S * 1/2010 Lane, III ..... D2/951
7,654,014 B1 2/2010 Moore et al.
7,665,229 B2 2/2010 Kilgore et al.
7,673,400 B2 3/2010 Brown et al.
7,685,741 B2 3/2010 Friedman
7,685,745 B2 3/2010 Kuhtz et al.
7,762,009 B2 7/2010 Gerber
7,866,064 B2 1/2011 Gerber
8,074,379 B2 12/2011 Robinson
D703,930 S * 5/2014 Grott ..... D2/951
2002/0004999 A1 1/2002 Caine
2005/0097783 A1 5/2005 Mills et al.
2005/0120593 A1 6/2005 Mason
2006/0042124 A1 3/2006 Mills et al.
2006/0242863 A1 * 11/2006 Patmore ..... 36/127
2007/0039209 A1 2/2007 White et al.
2007/0199213 A1 * 8/2007 Campbell et al. ... A43B 3/0057 36/102
2007/0266597 A1 11/2007 Jones
2008/0010863 A1 1/2008 Auger et al.
2008/0098624 A1 5/2008 Goldman
2008/0282579 A1 * 11/2008 Bobbett et al. ..... 36/127
2009/0019732 A1 1/2009 Sussmann
2009/0056169 A1 * 3/2009 Robinson et al. ..... 36/102
2009/0100716 A1 4/2009 Gerber
2009/0100718 A1 4/2009 Gerber
2009/0113758 A1 5/2009 Nishiwaki et al.
2009/0113765 A1 * 5/2009 Robinson et al. ..... 36/127
2009/0241377 A1 10/2009 Kita et al.
2009/0249648 A1 * 10/2009 Brown et al. ..... 36/91
2009/0249652 A1 10/2009 Gunthel et al.
2009/0272008 A1 11/2009 Nomi et al.
2009/0293315 A1 12/2009 Auger et al.
2010/0050471 A1 3/2010 Kim
2010/0126044 A1 5/2010 Davis
2010/0199523 A1 8/2010 Mayden et al.
2010/0199525 A1 8/2010 Thielen
2010/0229427 A1 9/2010 Campbell et al.
2011/0088287 A1 4/2011 Auger et al.
2011/0203140 A1 8/2011 Robinson
2012/0233886 A1 * 9/2012 Madore et al. ..... 36/103
2012/0285044 A1 * 11/2012 Bacon et al. ..... 36/103

FOREIGN PATENT DOCUMENTS

DE 4417563 11/1995
DE 19817579 10/1999
EP 115663 8/1984
EP 123550 10/1984

(56) References Cited

FOREIGN PATENT DOCUMENTS

| | | |
|---|---|---|
| GB | 2113971 | 8/1983 |
| GB | 2425706 | 11/2006 |
| JP | 10066605 | 3/1998 |
| JP | 2002272506 | 9/2002 |
| JP | 2002306207 | 10/2002 |
| JP | 2005185303 | 7/2005 |
| JP | 2005304653 | 11/2005 |
| JP | 2006020953 | 1/2006 |
| JP | 2008212532 | 9/2008 |
| WO | 03045182 | 6/2003 |

OTHER PUBLICATIONS

Pending U.S. Appl. No. 13/234,183, filed Sep. 16, 2011.
Pending U.S. Appl. No. 13/234,185, filed Sep. 16, 2011.
Pending U.S. Appl. No. 13/009,549, filed Jan. 19, 2011.
Pending U.S. Appl. No. 13/234,244, filed Sep. 16, 2011.
Pending U.S. Appl. No. 12/582,252, filed Oct. 20, 2009.
Pending U.S. Appl. No. 13/234,233, filed Sep. 16, 2011.
Pending U.S. Appl. No. 13/234,180, filed Sep. 16, 2011.

* cited by examiner

OUTSOLE OF A FOOTWEAR ARTICLE, HAVING FIN TRACTION ELEMENTS

BACKGROUND

"Outsole" is a term often used to describe bottom portions of a shoe sole structure. An outsole, or various parts of the outsole, will typically contact the ground when a shoe wearer stands or when the wearer walks or otherwise moves relative to the ground. In sports and other activities, a person's foot positioning may vary greatly, as necessary to support and/or transfer that person's weight appropriately, during a range of different body motions. An outsole designed to enhance performance during one type of motion, related to a given activity such as a sport, may not be ideal for different types of motions related to that activity. For example, some types of outsole elements may help increase traction and/or stability when a shoe wearer walks or traverses various types of surfaces and grades. However, that same shoe may also be worn when performing other activities that do not require the same type of forward-propelling effort, but instead require an effective weight-transferring effort. During those other activities, involving a body motion that differs from motions experienced while walking, it may be more desirable to stabilize the wearer's foot with outsole elements specific for that body motion.

Golf is one example of an activity in which a person's feet repeatedly experience different types of motions and must support a variety of body positions. A golfer may spend large amounts of time walking. Much of that walking may be over uneven surfaces, surfaces that might be slippery due to moisture, and/or surfaces that vary greatly in texture, including granular surfaces such as sand. It may therefore be desirable to include outsole elements that can increase traction when moving across a variety of surfaces. In addition, however, the technique a golfer uses to swing a club is major determinant of that golfer's overall success. In this regard, proper foot placement, movement, stability, and traction are all important aspects of a golf swing. Due to the basic differences in foot conformations needed for walking motions, compared to those needed for golf club swinging motions, outsoles that increase fraction while walking a golf course may not be optimal for stabilizing a wearer's feet while swinging a golf club.

SUMMARY

This Summary is provided to introduce a selection of concepts in a simplified form that are further described below in the Detailed Description. This Summary is not intended to identify key or essential features of the invention.

An outsole as described herein includes a number of features acting alone or in combination to provide a desired degree of foot traction and/or stability when the wearer performs a number of different motions that accompany a given activity. These features of the outsole can include multiple traction elements of various types. These traction elements may extend outward from one or more planar base surfaces of the outsole such that, when the outsole or portion thereof contacts the ground, the traction elements can penetrate into grass, sand or other ground material so as to increase traction and enhance stability of the shoe wearer foot. As explained in greater detail below, different traction element types are configured to increase traction and foot stability under different conditions.

In addition to various traction elements, other features such as flexure zones may be incorporated in the outsole, for example in the form of deep "sipes," to vary its thickness in desired locations and/or otherwise define, in combination with the medial or lateral outer edges of the bottom of the outsole, regions of the outsole (e.g., corresponding to portions of the bottom surface of the outsole) that can flex or move relatively independently of the movement of other regions. The flexure zones can therefore cooperate, as described in greater detail below, to provide isolated regions of traction, i.e., regions with various traction elements that are decoupled from one another. In particular embodiments, extended flexure zones may be "carved out" or depressed, relative to surrounding, planar areas of the outsole bottom surface, in order to create zones in which the outsole is thinned. Stresses placed on the outsole, which accompany the normal motions of walking or golf club swinging, will result in preferential bending or flexing of the outsole along such thinned flexure zones, allowing relative movement between regions of the outsole bottom surface that are separated or defined by the flexure zones. Such relative movement, together with selected traction elements or combinations of traction elements within the regions, act to provide desirable support and fraction for a number of motions that normally accompany a given activity such as golf.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1:
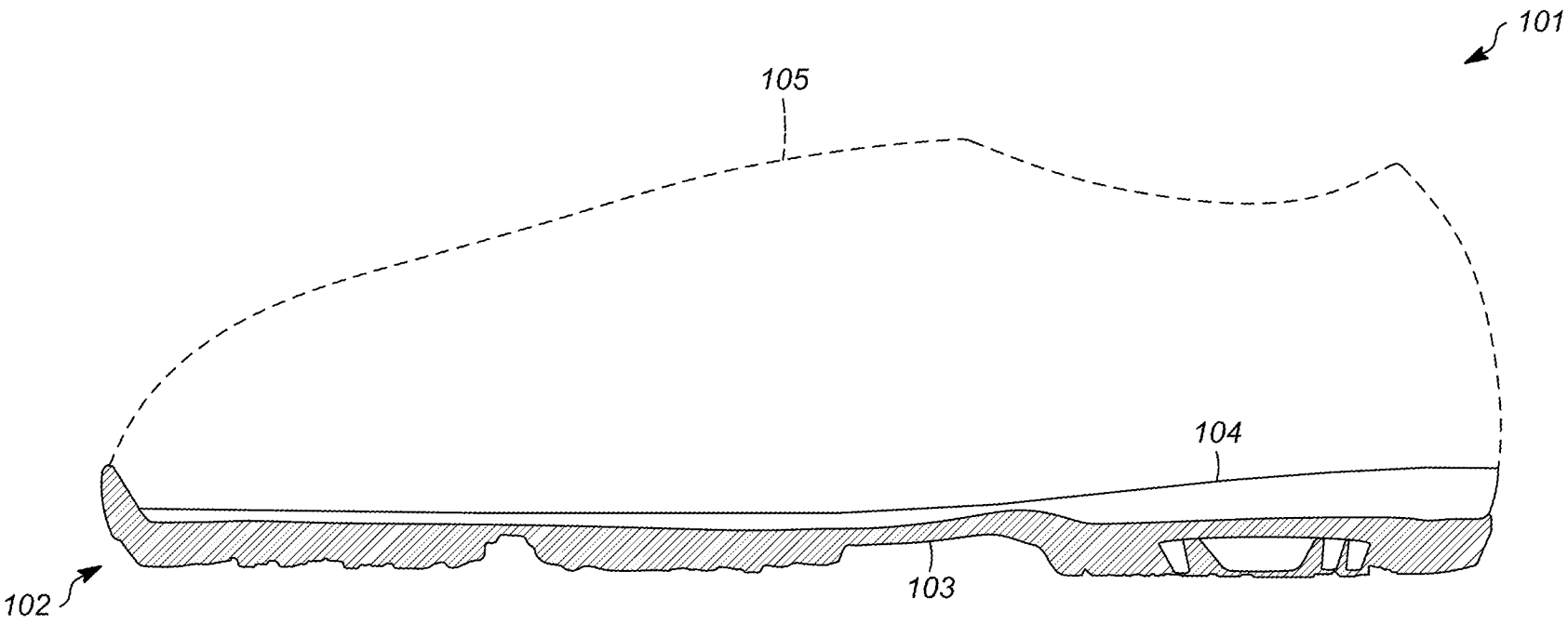
FIG. 1 is a lateral side view of an article of footwear according to some embodiments.

The degree to which the outsole is thinned in a flexure zone, relating to the degree to which different regions bounded by the flexure zone can move independently, can be expressed as a depth dimension. The flexure zone depth is measured relative to the elevation of a generally planar area of the outsole bottom surface, proximate the flexure zone. This generally planar area would otherwise include the surface of the outsole material in the area of the flexure zone, had this material not been eliminated in order to create the flexure zone. The generally planar area can correspond to the surface area of an outsole plate. In some embodiments, a flexure zone has a maximum depth of at least about 3 mm (0.12 in), for example from about 5 mm (0.20 in) to about 15 mm (0.59 in). This maximum depth may represent from about 10% to about 95%, for example from about 25% to about 50%, of the maximum thickness of the outsole and thereby result in a substantial "thinning" of the outsole in a given flexure zone. In other embodiments, all of part of the flexure zone may extend completely through the outsole and expose a portion of the midsole.

The depth of a flexure zone may be constant, or the flexure zone may, for example, have a maximum depth at a central length section and decreased depths at outer length sections (or free ends). In some embodiments, the depth of the flexure zone may decrease to essentially 0 at its outer length sections, such it tapers or "disappears" into a generally planar, proximate area. In other embodiments, a flexure zone may extend completely to one or two outer edges, for example, it may extend across the bottom surface of the outsole from the medial edge to the lateral edge. In such embodiments, the profile of the flexure zone, and particularly its depth at the edge of a bottom surface, may be visible on a side surface of the outsole.

The length of a flexure zone is typically its longest dimension, measured along a planar area of the outsole bottom surface, below which the flexure zone is depressed. If the flexure zone is made up of more than one segment, its length is the total length of all of its segments, measured along this planar area. Generally, however, a flexure zone comprises one extended segment having straight and/or curved portions. Flexure zones have lengths that are normally significantly greater than the lengths of traction elements, including both fin and ridge traction elements as described below. For example, the length of the longest flexure zone may exceed that of the longest traction element by a factor of about 2 or more, for example about 3 to about 8 or about 4 to about 7.

Representative lengths of flexure zones are greater than about 2 cm (0.79 in), for example from about 3 cm (1.18 in) to about 25 cm (9.8 in), and often from about 5 cm (2.0 in) to about 20 cm (7.9 in). The width of a flexure zone is measured transverse, relative to its length, and may remain essentially constant over the length of a flexure zone or may vary. Representative average widths of flexure zones, which may correspond to the average distances between discreet regions of the outsole surface that are separated by, or at least partly defined by, these flexure zones, are greater than about 2 mm (0.079 in), for example from about 3 mm (0.12 in) to about 15 mm (0.59 in). These dimensions of flexure zones (lengths, widths, and depths) can allow one or more flexure zones to effectively separate various regions of the outsole surface. Therefore, these separated regions and associated traction elements disposed within them, as described in greater detail below, can move with relative independence.

In at least some embodiments, an outsole of an article of footwear comprises a number of features including various traction elements that contact the surface across which the wearer traverses and/or upon which the wearer performs an activity. Different regions of the outsole may contain traction elements that differ in number and/or kind. Importantly, however, the placement of traction elements is not limited to regions bounded by the medial or lateral outer edges of the bottom of the outsole, but in some embodiments may also extend from exposed medial and/or lateral side surfaces of the outsole to provide traction, stability, and support when the wearer's foot is "rolled," for example during the weight transfer that accompanies the execution of a golf swing. At least temporarily during the course of such a motion (e.g., during the follow-through), fraction elements outside the periphery of the bottom surface of the outsole may contact the ground to achieve a desired performance characteristic of the footwear article.

Examples of traction elements that may be used within regions of an outsole bottom surface (e.g., defined at least partly by extended flexure zones) include raised traction elements such as fin traction elements, ridge traction elements, and spike traction elements. Fin traction elements may extend in a length direction (e.g., a toe-heel direction or a lateral-medial direction) within a region of an outsole, and often reside entirely within a given region of the outsole bottom surface, which is at least partly defined by flexure zones and/or outer edges (medial or lateral) of the bottom of the outsole. Preferably, fin traction elements do not extend in a length direction that is proximate, or generally aligned with, either a flexure zone or an outer edge (medial or lateral) of the bottom of the outsole.

A ridge fraction element may include at least one peripheral segment that extends in one length direction, and at least one associated transverse segment that extends in a different length direction. For example, the transverse segment may extend generally widthwise across the outsole (i.e., in a lateral-medial direction across a portion of the width of the wearer's foot), whereas the peripheral segment may extend generally lengthwise (i.e., in a toe-heel direction across a portion of the length of the wearer's foot). The peripheral segment may extend in a length direction that is proximate and generally aligned with a flexure zone and/or a medial or outer lateral edge of the outsole. In particular embodiments, both the peripheral and transverse segments of a ridge traction element may extend in a length direction that is proximate and generally aligned with a flexure zone and/or a medial or lateral outer edge of the outsole, thereby extending in length directions along at least two borders (or portions thereof) of a region of the outsole bottom surface.

The length of a fin or ridge traction element is typically its longest dimension, measured along a planar area of the outsole bottom surface, above which the fin or ridge traction element rises. If the fin or ridge traction element is made up of more than one segment, its length is the total length of all of its segments, measured along this planar area. Generally, however, a fin traction element has one extended segment having straight and/or curved portions, whereas a ridge fraction element has two such extended segments. Generally, fin and ridge traction elements have lengths that are greater than the lengths of other types of traction elements, such as spike traction elements. Representative lengths of fin and ridge traction elements are greater than about 3 mm (0.12 in), for example from about 5 mm (0.20 in) to about 20 mm (0.79 in). These lengths can allow one or more fin and/or ridge elements to provide stability on a penetrable surface (e.g., soil), particularly during the foot motion that accompanies the body weight transfer involved in swinging a golf club.

At least a portion, and possibly all, of the fin traction elements and/or the ridge traction elements may have a height that decreases over all or a portion of the length of these elements. The height of these traction elements refers to the dimension of their downward protrusion, when the article of footwear is placed in its upright position, relative to a generally planar area of the outsole bottom surface, proximate the traction element. In the case of a fin traction element, in one example whereby its height decreases over portions of its length, this element has a curved, protruding shape such that a central length section of the fin traction element protrudes downward to a greater extent, relative to outer length sections, and thereby has the ability to penetrate a penetrable surface (e.g., soil) to a greater depth, under the weight of the wearer. Likewise, in the case of a ridge traction element, in one example whereby its height decreases over portions of its length, this element has a curved, protruding shape such that a central length section of the ridge traction element, namely a section proximate the point of intersection between a peripheral segment and an associated transverse segment, protrudes downward to a greater extent, relative to outer length sections that are distant from this point of intersection. The central length section of a fin or ridge traction element may therefore correspond to a section of maximum height of such traction elements. In some embodiments, the height may decrease to essentially 0 at the outer length sections of fin or ridge traction element, such that the traction element tapers or "disappears" into a generally planar, proximate area. Representative maximum heights of fin or ridge traction elements are greater than about 2 mm (0.079 in), for example from about 3 mm (0.12 in) to about 10 mm (0.39 in). In general, fin and/or ridge traction elements have smooth top surfaces that are either flat, like the edge surface of a penny, or otherwise tapered to a create a finer top surface, like the edge of a knife, to allow easier penetration into a soft surface such as soil. In other embodiments, fin and/or ridge traction elements can have reeded top surfaces, like the edge surface of a quarter, or otherwise a jagged or saw-toothed top surface to provide a desired degree of traction and/or soil penetration. In still other embodiments, a smooth but wavy top surface may be used.

In some embodiments, an outsole may include additional types of traction elements, some or all of which may be located in regions of the bottom surface of the outsole that are at least partly defined by flexure zones and/or outer edges (medial or later) of the bottom of the outsole. Representative traction elements include spike traction elements having, for example, circular, elliptical, polygonal (e.g., rectangular such as square), or rounded polygonal cross sectional areas, in a plane that encompasses, or is at a greater height and parallel to, a planar area of the outsole that is proximate the traction element. In this regard, such traction elements generally do not extend lengthwise in any one direction over the bottom surface of the outsole, to the extent discussed above with respect to fin and ridge traction elements. Representative spike traction elements, for example, extend in a length direction, for example corresponding only to the longest dimension across their circular or elliptical cross sectional areas, of less than about 10 mm (0.39 in), for example from about 2 mm (0.079 in) to about 8 mm (0.31 in).

Despite their relatively short length, spike fraction elements may have a substantial height, which refers to the dimension of its maximum protrusion, when the article of footwear is placed in its upright position, relative to a planar area of the outsole bottom surface, proximate the traction element. Representative heights of spike traction elements are greater than about 3 mm (0.12 in), for example from about 5 mm (0.20 in) to about 15 mm (0.59 in). This height can allow one or more spike elements to serve a primary purpose of providing traction on a penetrable surface (e.g., soil). In particular embodiments, at least one spike element, and possibly a plurality of spike elements, and in some cases all of the spike elements, has/have a height that is greater than the height of all of the fin traction elements and/or the height of all of the ridge traction elements, measured as described above. In such embodiments, this at least one spike element, or plurality of spike elements, may protrude below all of the fin and/or ridge traction elements when the article of footwear is placed in its upright position. In the case of the article of footwear being placed on a relatively impenetrable surface (e.g., concrete) and in the absence of downward forces exerted by a wearer, this at least one spike element, or plurality of spike elements, may be the only traction elements that make contact with this surface.

Specific types of spike traction elements include circumferential spike traction elements that protrude from positions on the bottom surface of the outsole, which can generally reside on a common circle. Preferably, the common circle is within a given region of an outsole bottom surface that is defined at least partly by extended flexure zones. Spike traction elements may therefore be present as "clusters" of at least three (e.g., 3, 4, 5, 6, 7, 8, 9, or 10) circumferential spike traction elements, generally having the same or similar geometry and dimensions. In some embodiments, spike fraction elements, including such clusters, may be removable and/or replaceable with differing spike traction elements, in order to accommodate the different playing conditions and/or demands encountered in a given activity.

In certain embodiments, the outsole may comprise various additional traction elements in any of the regions of the outsole bottom surface as described below, and/or an exposed medial or lateral side surface of the outsole.

FIG. 1 is a lateral side view of a shoe 101 according to some embodiments. Shoe 101 can be a shoe intended for wear by a golfer. Embodiments can also include footwear for use in other athletic and non-athletic activities. Shoe 101 includes a sole structure 102. Although various specific features of sole structure 102 are described below, such description merely provides examples of features according to certain embodiments.

Sole structure 102 includes an outsole 103 and a midsole 104. These and other components of sole structure 102 are further described below. In other embodiments, a sole structure may only include an outsole or might otherwise lack a separate midsole. In embodiments that include a separate midsole, the midsole can be external, e.g., located outside of an upper 105 and having exposed portions visible on the shoe exterior (such as in the embodiment of shoe 101). In other embodiments, a midsole may be internal, e.g., located within an upper. Outsole 103 covers the entire bottom surface of shoe 101. In other embodiments, an outsole may not cover the entire bottom surface and may include openings that expose a midsole or other shoe component. In still other embodiments, a sole structure could include a support plate and/or other component(s). Shoe 101 also includes upper 105, mentioned above. Shoes having sole structures according to various embodiments can include various types of uppers. Because the details of such uppers are not germane to understanding sole structures disclosed herein, upper 105 is shown generically in FIG. 1 using a broken line. Elements of outsole 103, including flexure zones and traction elements, are described in detail below. Such elements may be visible in a side view, for example as in the embodiment of FIG. 4, which depicts side-extending traction elements on a medial side surface of outsole 103. In other embodiments, such fraction elements may be visible on a lateral side surface.

Various locations of an outsole may be identified in terms of the corresponding, proximate foot bones of a person wearing a shoe that includes the outsole. Identifications in this manner assume that the shoe is properly sized for the wearing foot. When referring to an outsole or other component of a sole structure, the designation "forefoot" generally refers to a location under or near the metatarsal and phalangeal bones of a shoe wearer's foot and may extend beyond the wearer's toes to the frontmost portion of the shoe. The forefoot may extend beyond the medial or lateral peripheral edge of the wearer's foot. The designation "midfoot" generally refers to a location under or near the cuboid, navicular, medial cuneiform, intermediate cuneiform and lateral cuneiform bones of the wearer's foot. The midfoot may also extend beyond the medial or lateral peripheral edge of the wearer's foot. The designation "hindfoot" generally refers to a location extending from the midfoot and under/near the wearer calcaneus (heel bone), which may extend to the rearmost portion of the shoe, and may also extend beyond the medial or lateral peripheral edge of the wearer's foot. One or more of the above-described locations corresponding to the designations "forefoot," "midfoot," and "hindfoot" may overlap, and description of an outsole component by reference to a particular anatomical location does not require that the component cover that entire anatomical region. For example, as discussed below with reference to FIG. 2, a flexure zone may extend across the forefoot, midfoot, or other location, despite the presence of planar areas and traction elements also being in these locations, albeit outside the flexure zones.

Figure 2:
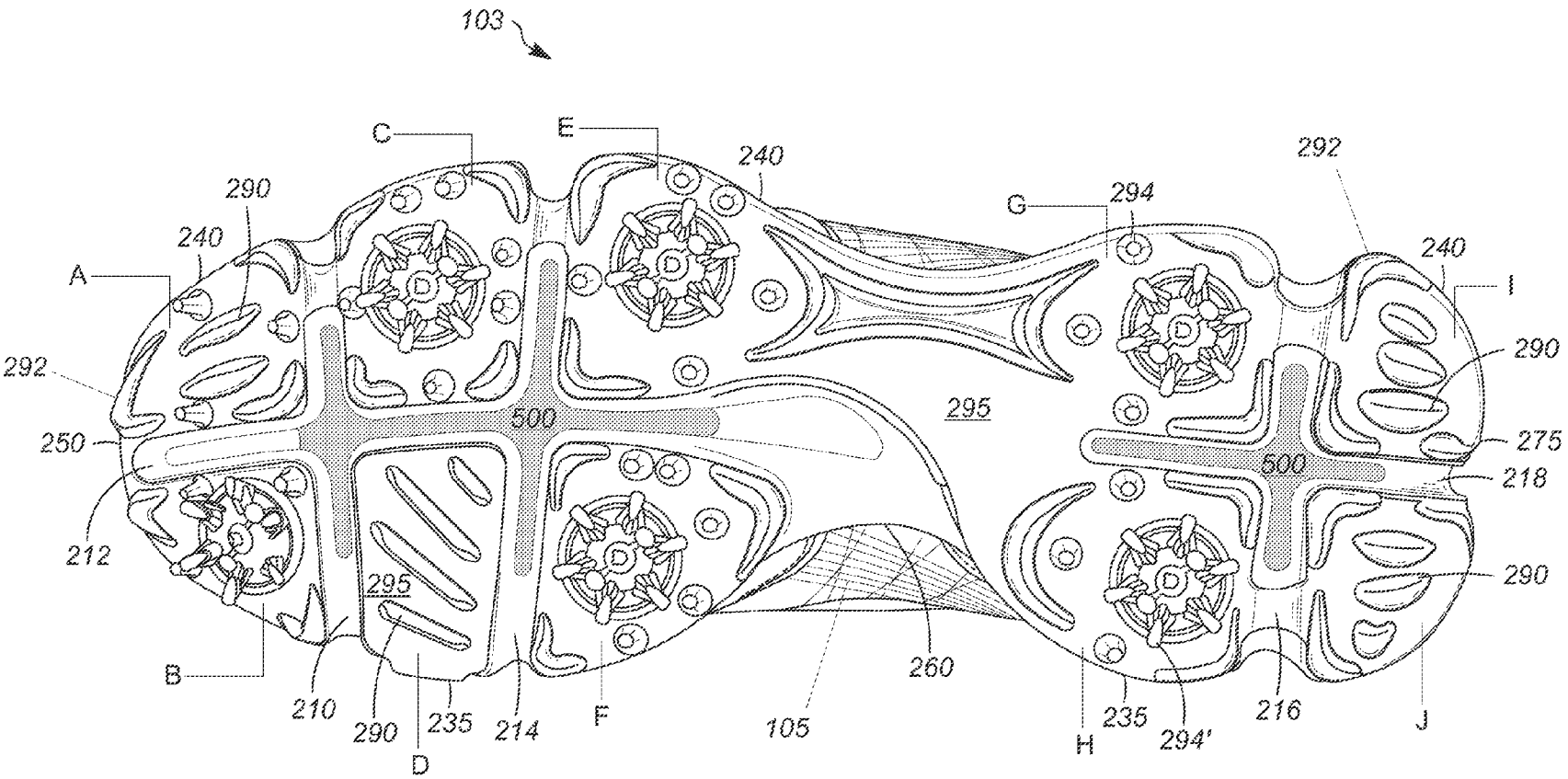
FIG. 2 is a bottom view of the outsole of the article of footwear of FIG. 1.

FIG. 2 is a bottom view of the article of footwear of FIG. 1, showing details of the bottom surface of outsole 103. In the embodiment of this figure, first flexure zone 210, corresponding to an elongated zone of depression into the outsole 103, extends widthwise (i.e., in a lateral-medial direction). In the embodiment of FIG. 2, first flexure zone 210 extends completely across a forefoot region of outsole 103, although in other embodiments it may extend only partly across outsole 103, for example it may extend substantially (i.e., a majority of the way) across. In addition, second flexure zone 212 intersects first flexure zone 210 and extends lengthwise (i.e., in a toe-heel direction) across the forefoot region of outsole 103, in a substantially transverse manner with respect to first flexure zone 210. Second flexure zone 212 is shown as having a small width at one end, near a toe edge 250, which increases substantially at a second end, near a midfoot edge 260, where second flexure zone 212 curves, from the lengthwise direction to the widthwise direction, toward the medial side of outsole 103. Although second flexure zone 212 does not extend in the same direction over its entire length, it nevertheless extends lengthwise over a majority of its length, and particularly where it intersects first flexure zone 210, and therefore extends lengthwise for purposes of this disclosure. In general, second flexure zone 212 can extend lengthwise from at least a toe region as defined above (e.g., it can extend from toe edge 250), through a forefoot region as defined above, and at least partly into a midfoot region as defined above.

Figure 4:
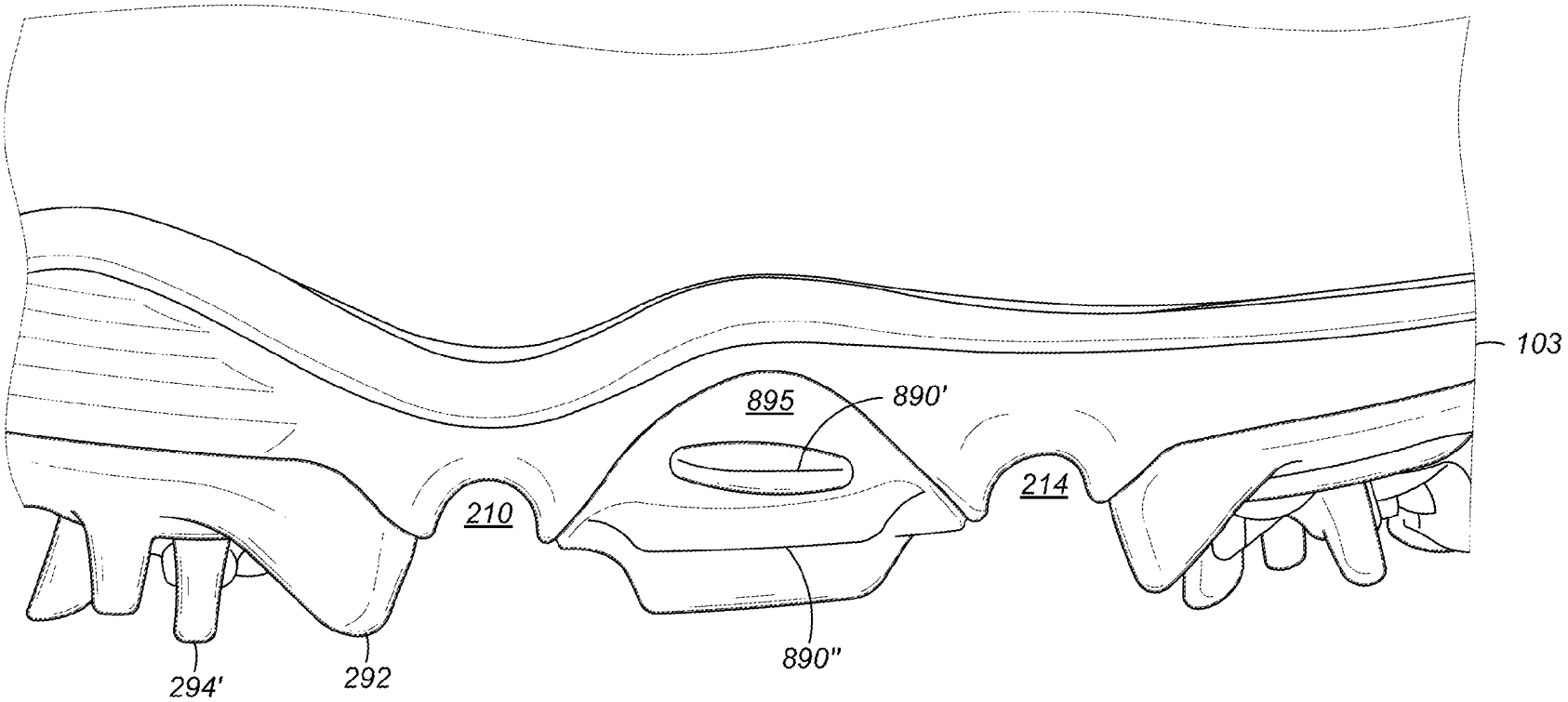
FIG. 4 is an enlarged view of the front portion of the exposed medial side surface of the outsole depicted in FIG. 2.

Third flexure zone 214, like first flexure zone 210, extends widthwise and at least partly (e.g., substantially or completely) across outsole 103, in a direction substantially parallel to first flexure zone 210. Third flexure zone 214 is also located in a forefoot region, but further from toe edge 250, relative to first flexure zone 210. In the embodiment of FIG. 2, both first flexure zone 210 and third flexure zone 214 intersect second flexure zone 212, but first and third flexure zones do not intersect each other. By virtue of first and third flexure zones 210, 214 extending completely across outsole 103, their indentations into outsole 103 are visible on the medial side surface of outsole 103, as depicted in FIG. 4.

First and second flexure zones 210, 212 intersect to define, together with medial outer edge 235, lateral outer edge 240, and third flexure zone 214, a number of regions upon which traction elements, as described above, may be positioned to impart traction, support, and stability characteristics, and also to vary these characteristics, in the regions as desired. In the embodiment of FIG. 2, for example, first, second, and third flexure zones 210, 212, 214 divide outsole 103 into lateral toe region A, medial toe region B, forward lateral forefoot region C, forward medial forefoot region D, rear lateral forefoot region E, and rear medial forefoot region F. It is possible for rear lateral and medial forefoot regions E, F to extend at least partly into the midfoot region, as defined above. In other embodiments, for example where the forefoot region is divided by only first and second flexure zones 210, 212 but not a third flexure zone, then these flexure zones may define, in combination with medial and lateral outer edges 235, 240, only regions A-D, but not E and F. In this case it is possible for forward lateral and medial forefoot regions C, D (which in such an embodiment may be more simply referred to as lateral forefoot region C and medial forefoot region D) to extend at least partly into the midfoot region, as defined above. In any of these embodiments, fin traction elements are advantageously included in at least two of these regions selected from A-D or otherwise selected from A-F, where borders of these regions are at least partly, but in many embodiments completely, defined by the outer edges of the outsole, in combination with the flexure zones.

In the specific embodiment of FIG. 2, additional flexure zones, and particularly widthwise-extending hindfoot flexure zone 216 and lengthwise-extending hindfoot flexure zone 218, intersecting substantially perpendicularly, divide the hindfoot region into additional regions that are similarly defined by flexure zones 216, 218, in combination with medial and lateral outer edges 235, 240. These regions are namely forward lateral heel region G, forward medial heel region H, rear lateral heel region I, and rear medial heel region J. Widthwise-extending hindfoot flexure zone 216, like first and third flexure zones 210, 214, extends completely across outsole 103 in the embodiment of FIG. 2. Lengthwise-extending hindfoot flexure zone 218 extends completely to heel edge 275 at one end and terminates in the hindfoot region at its opposite end. As shown, fin traction elements 290 are included in both rear lateral heel region I and rear medial heel region J, as well as in forward medial forefoot region D and lateral toe region A. This particular configuration of fin traction elements advantageously imparts a "track-type" geometry in roll zones of a golf swing, thereby creating a smoother transition, with greater ease of the natural golf swing motion for the wearer. It has been discovered that regions A, D, I, and J receive substantial rotational force and widely varying pressures over the course of a golf swing. Both traction and stability in these regions can be enhanced with the configuration of fin traction elements 290 in the embodiment of FIG. 2, in addition to other embodiments described herein.

Flexure zones defining, and traction elements in, regions of outsole 103 (e.g., fin traction elements), may have any of the characteristics, or any combination of characteristics, including dimensions, as discussed above with respect to these features. As noted above, the depth of a flexure zone or height of a traction element may be measured with respect to a planar area of the outsole bottom surface that is proximate the traction element. For example, the height of fin fraction elements 290 in forward medial forefoot region D and the depth of first flexure zone 210 may be measured relative to proximate planar area 295.

As also shown in FIG. 2, the bottom surface of outsole 103 may include openings 500, at least in locations corresponding to portions of flexure zones (e.g., those portions of greatest depth), such that midsole material is exposed in these locations. In FIG. 2, the open areas of outsole 103, corresponding to the locations in flexure zones where midsole material is exposed, are shaded. These locations may include some of all areas of intersection of two or more flexure zones. Openings 500, through which midsole material may be exposed, may be incorporated to promote flexibility. The midsole component of the sole structure in the embodiment of FIG. 2, or in other embodiments described herein, may constitute one or more parts and may extend to cover the entire plantar surface of a wearer's foot or one or more portions thereof. While other midsole constructions are possible, in accordance with some examples of this invention, some or all of the midsole component may include a foam material (such as ethylene vinyl acetate ("EVA") foam, polyurethane foam, phylon foam, or phylite foam). In some more specific examples of this invention, at least some portion(s) of the midsole component will be made from a foam material having a density of less than 0.25 $g/cm^3$ (and in some examples, a density of less than 0.2 $g/cm^3$, within the range of 0.075 to 0.2 $g/cm^3$, and even within the range of 0.1 to 0.18 $g/cm^3$). If desired, the foam material may include one or more openings defined therein and/or another impact-force attenuating component included with it, such as a fluid-filled bladder. In certain embodiments of this invention, the entire midsole component will constitute this lightweight foam material (e.g., with a density feature as described above) and will extend to support the complete foot of the wearer (e.g., the complete plantar surface).

According to representative examples, at least some of the midsole component may be made from a two-part foam component as described, for example, in U.S. Pat. No. 7,941,938 (e.g., a harder, denser, more durable foam carrier or shell in which a softer, less dense, less durable, and lightweight foam insert or core is provided), which patent is entirely incorporated herein by reference. When one or more two-part components are present in a sole structure like that shown in FIG. 2, the exposed midsole foam material at the bottom of the outsole may constitute the harder, denser, more durable foam carrier or shell (e.g., conventional phylon or EVA), although other structures or arrangements are possible. As yet additional examples, if desired, at least some portion of the midsole component may be made from foam materials and/or foam components in the LUNAR family of footwear products available from NIKE, Inc. of Beaverton, Oreg.

The provision of traction and stability across the full range of foot movement during a golf swing may, in some embodiments, be further supplemented through the use of side-extending fin fraction elements, protruding outwardly from exposed medial and/or lateral side surfaces of outsole 103. Representative side-extending fin traction elements are illustrated in the medial side view of FIG. 4, showing the front portion (corresponding to the forefoot region) of the exposed medial side surface. A first side-extending fin traction element 890' protrudes in a substantially horizontal direction when the article of footwear is in its upright position. A second, adjacent side-extending fin traction element 890" extends at an angle that is pitched downward from horizontal. These side-extending fin traction elements 890', 890" cooperate to provide a relatively constant level of traction and stability, throughout the entire "roll" performed by the wearer's foot during a golf swing. These side-extending fin traction elements 890', 890" have characteristics, including dimensions (e.g., a length dimension), as described above with respect to fin traction elements and as illustrated in FIG. 2. Because side-extending fin fraction elements 890', 890" extend outward (rather than downward), however, and in particular extend beyond an outer edge of the outsole, the height of side-extending fin traction elements 890', 890" is determined with respect to a planar area (895 in FIG. 4) of the exposed, corresponding medial or lateral side surface that is proximate the traction element. Side-extending fin traction elements 890', 890" in the embodiment of FIG. 4 extend beyond an outer edge of the outsole, wherein this proximate outer edge borders forward medial forefoot region (D in FIG. 1). In other embodiments, outer edges proximate other side-extending fin traction elements may border other regions, including any regions A-J as described above, or any combination of regions. For example, side-extending fin traction elements outside of forward medial forefoot region D (as depicted in FIG. 4), but also outside of forward lateral forefoot region C can provide desired traction and stability over an extreme range of a lateral-medial rolling motion, across the entire forefoot region of the article of footwear.

Figure 3:
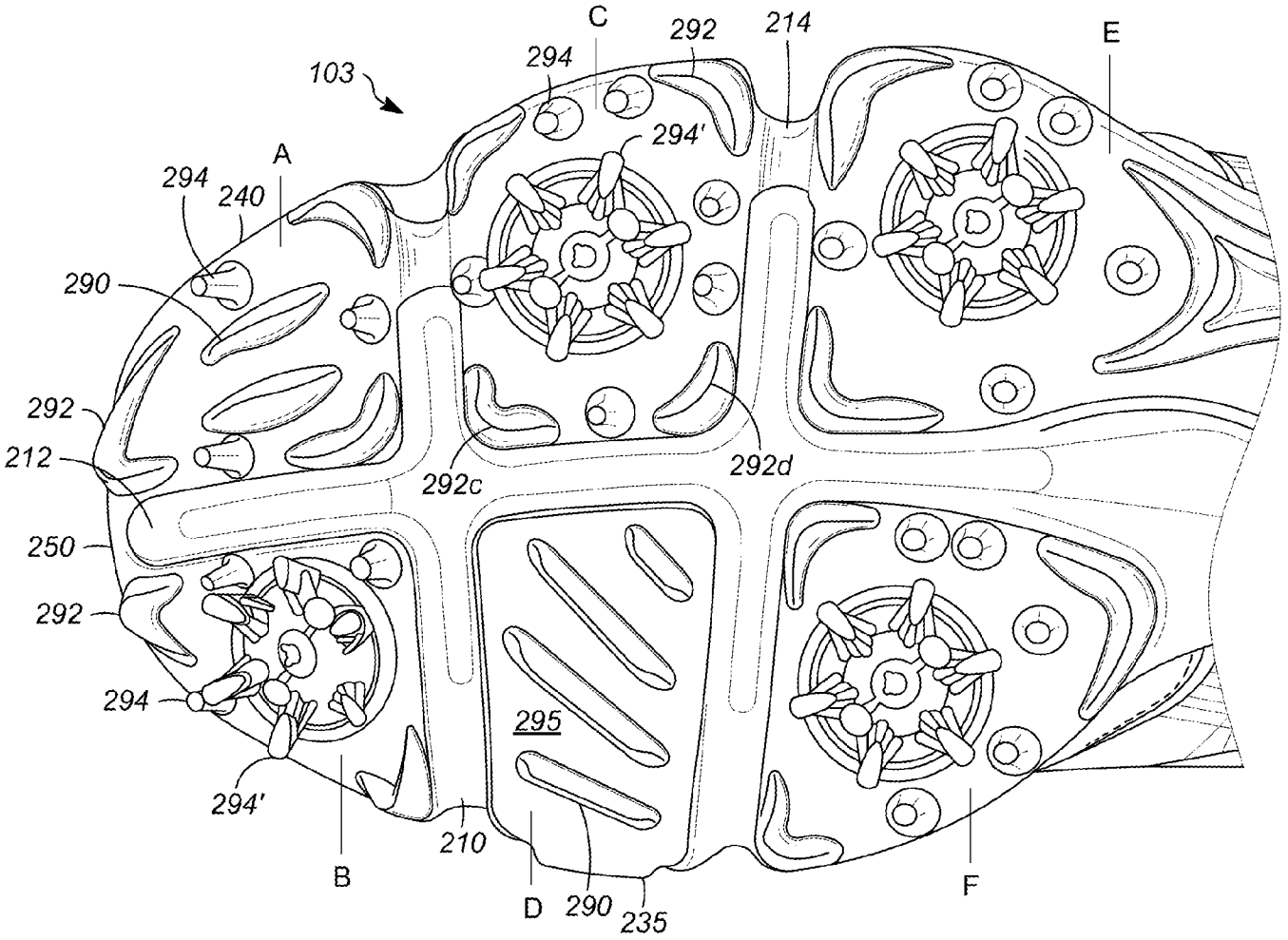
FIG. 3 is an enlarged bottom view of the front portion the outsole depicted in FIG. 2.

The bottom view of the outsole front portion, depicted in FIG. 3, provides a close up of regions A-F in forefoot and midfoot regions, in the embodiment of FIG. 2. Good stability characteristics, particularly with respect to the foot motion that accompanies a golf swing, are obtained using a plurality of fin traction elements 290 in both lateral toe region A and forward medial forefoot region D. In the embodiment of FIG. 3, fin traction elements 290 are centrally disposed in lateral toe region A, with respect to other types of traction elements, namely ridge traction elements 292 and spike traction elements 294. In this region, fin traction elements 290 extend substantially lengthwise (i.e., in a toe-heel direction) substantially parallel to second flexure zone 212, or they are otherwise angled such that their ends proximate lateral outer edge 240 are further removed from toe edge 250, relative to their opposite ends. In forward medial forefoot region D according to this embodiment, fin traction elements 290 are the only type present, and are angled such that their ends proximate medial outer edge 235 are further removed from toe edge 250, relative to their opposite ends.

In some embodiments of the invention, such as the embodiment of FIG. 3, at least one of regions of A-D (e.g., medial toe region B and/or forward lateral forefoot region C), which includes a plurality of fin traction elements 290, further includes at least one other type of traction element, for example a plurality of ridge traction elements 292. In the case of regions (e.g., A and D) that include fin traction elements 290, at least one of these ridge traction elements may be proximate borders of these regions A, D that are defined by flexure zones 210, 212, 214 in the forefoot region. For example, in the embodiment of FIG. 3, one particular ridge traction element **292*a* is proximate the medial border of region A, and more specifically proximate the border defined by first and second flexure zones 210, 212. In this manner, good fraction of outsole 103 is maintained in the proximity of flexure zones 210, 212, 214** that otherwise provide reduced contact between the article of footwear and the ground.

Figure 5:
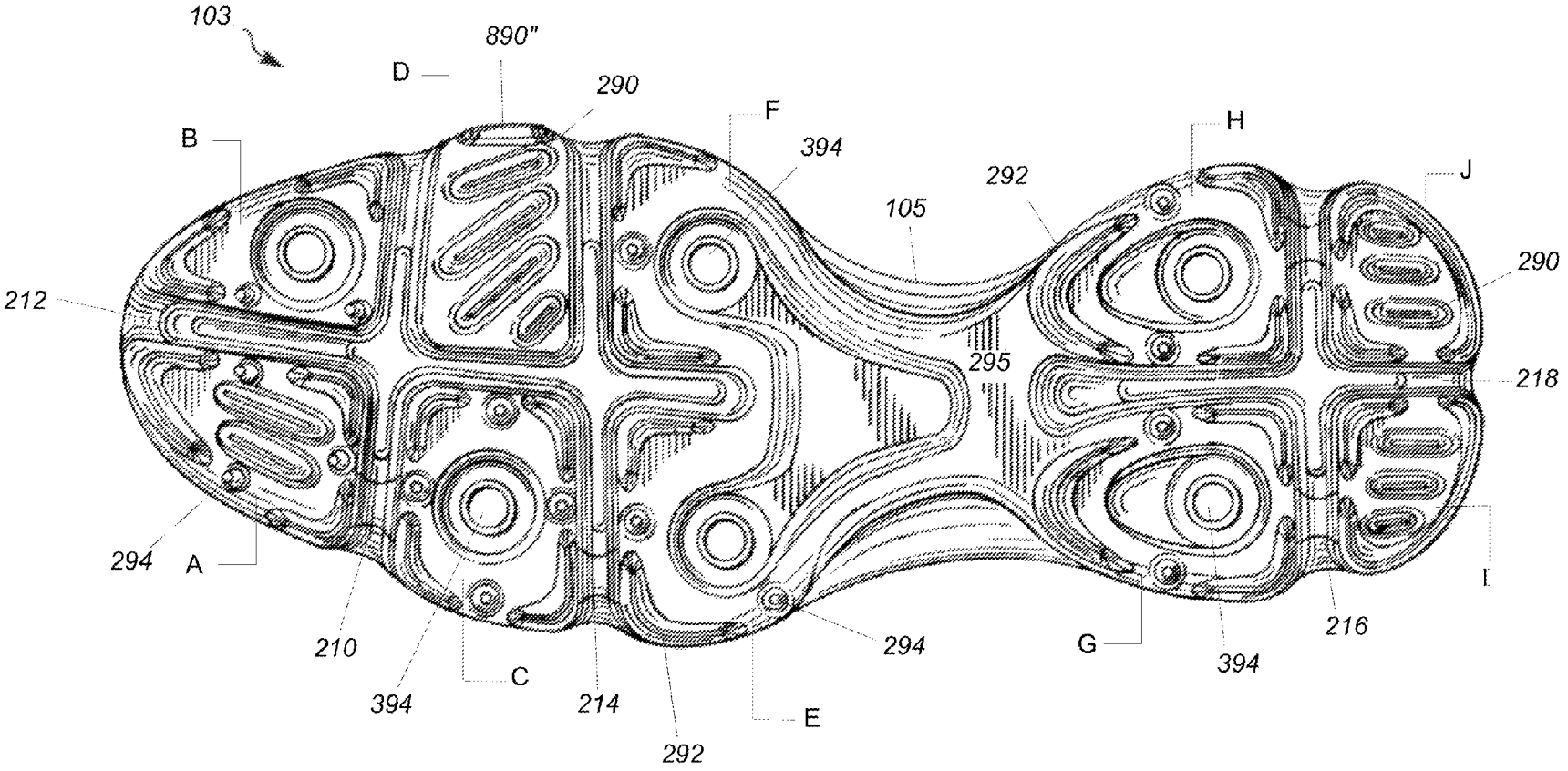
FIG. 5 is a bottom view of an outsole according to another embodiment, in which receptacles are used to engage removable cleats.

FIG. 5 depicts details of the bottom surface of an outsole 103, including flexure zones 210, 212, 214, 216, and 218; regions A-I; fin traction elements 290; ridge traction elements 292; spike traction elements 294; and other features as discussed above with respect to FIGS. 2-4, including side-extending fin traction element 890" that is visible in this embodiment, in the view of FIG. 5. Rather than the circumferential spike traction elements 294' shown in FIGS. 2-4, FIG. 5 depicts receptacles 394 for such elements or other traction elements, which may be removable and/or replaceable, as discussed above. These elements may therefore be in the form of removable cleats, for example in the form of a cluster of six circumferential spike traction elements 294', according to the embodiments of FIGS. 2-3. Receptacle 394 of FIG. 5 is adapted to engage a plurality of such removable cleats, using any desired cleat engaging technology, including threaded holes, cam, or turnbuckle type engagements.

Compared to the embodiment depicted in FIG. 2, another difference is in the overall, 2-dimensional shape of generally planar area 295 from which fraction elements can protrude and below which flexure zones may be depressed. Planar areas 295 in all regions A-I may generally lie substantially in a common plane associated with an outsole plate. The outsole plate may have an asymmetrical 2-dimensional shape, as depicted in the embodiment of FIG. 2, in which planar area 295 sweeps toward the lateral side of the shoe and thereby renders a relatively larger portion of shoe upper 105 visible on medial side compared to the lateral side, in the bottom view of FIG. 2. Alternatively, the outsole plate may have a substantially symmetrical 2-dimensional shape, as depicted in the embodiment of FIG. 5, in which planar area 295 extends more centrally across the midfoot, thereby rendering relatively equal portions of shoe upper 105 visible on the medial and lateral sides, in the bottom view of FIG. 5. The more symmetric bottom surface or planar area 295 in the embodiment of FIG. 5 may be better suited to accommodate or house an electronic module (not shown), such as a pedometer or other activity monitor or chip, including a "NIKE+™" chip, as known in the art.

It can also be appreciated from FIGS. 1 and 2 that not all regions A-D necessarily include fin traction elements 290. Rather, in some embodiments at least one region selected from lateral toe region A, medial toe region B, forward lateral forefoot region C, forward medial forefoot region D does not include a fin traction element. In the embodiment of FIGS. 1 and 2, both regions B and C do not include such a traction element. In any case, regions which do not include a fin traction element may include one or more of another type of traction element, for example one or more spike traction elements, one or more ridge traction elements, or otherwise a combination of various traction element types. In a particular embodiment, a region that does not include a fin traction element will have three or more circumferential spike traction elements as described above. For example, in the embodiment of FIG. 2, medial toe region B and forward lateral forefoot region C, although lacking fin traction elements, include both ridge traction elements 292 and spike traction elements 294. In addition, the spike traction elements 294 in each of these regions B, C include a cluster of circumferential spike traction elements 294', described above. Accordingly, in further embodiments, medial toe region B and forward lateral forefoot region C each include at least three circumferential spike traction elements 294', and these regions B, C may otherwise, or in addition, include a plurality of (e.g., two, three, or four) ridge fraction elements 292.

In the case of ridge traction elements 292 in regions B, C that do not include a fin traction element, at least two of these ridge traction elements may be proximate borders of these regions B, C that are defined by flexure zones 210, 212, 214 in the forefoot region. For example, in the embodiment of FIG. 3, two ridge traction elements 292 are proximate the medial border of region C, with one of these ridge traction elements 292*c* being proximate the border defined by first and second flexure zones 210, 212 and another of these ridge traction elements 292*d* being proximate the border defined by second and third flexure zones 212, 214. In this manner, regions that do not include fin traction elements 290 to assist in stabilizing the foot during the weight transfer that accompanies a golf swing, can nevertheless serve to maintain good traction of outsole 103 in the proximity of flexure zones 210, 212, 214 that otherwise provide reduced contact between the article of footwear and the ground.

In many cases, it may be desirable for spike traction elements 294, and particularly circumferential spike traction elements 294', to provide a primary source of traction for the wearer while walking. When such circumferential spike traction elements 294' are used, therefore, at least one, but preferably a portion or even all, of circumferential spike fraction elements 294' extend(s) to a height, as described above (i.e., relative to a generally planar and proximate area of the outsole bottom surface), which is greater than that of all other traction elements within the same region. In other embodiments, this height of circumferential spike traction element(s) 294' is greater than that of all of a plurality of fin traction elements 290 on outsole 103. In yet more particular embodiments, this height of circumferential spike traction element(s) 294' is greater than that of all other traction elements of outsole 103, whereby the circumferential spike traction element(s) 294', but no other traction elements, contact(s) a flat and impenetrable surface when the article of footwear is positioned thereupon in an upright, resting position (i.e., without being worn and therefore without deformation due to the downward forces of the wearer's weight). The above characteristics of circumferential spike traction elements 294' also apply to those in all regions A-J, described herein. For example, in the embodiment of FIG. 2, circumferential spike traction elements 294' (e.g., at least three) are also present in forward lateral and medial heel regions G, H.

Outsole 103 can be fabricated from any of various materials commonly used for athletic footwear outsoles. Such materials can include synthetic rubbers, "green" rubbers, thermoplastic polyurethane (TPU), etc. In some embodiments, higher durometer materials can be used for some or all traction elements and softer durometer materials can be used for other parts of the outsole. In FIG. 1, outsole 103 is bonded to a midsole 104. Midsole 104 (FIG. 1) can be formed from compressed ethylene vinyl acetate (EVA) foam (also known as "Phylon"), foamed TPU, or other materials.

Outsoles, such as outsole 103 and outsoles others according to other embodiments described herein, can offer several advantages during golf play. During a backswing, a player typically rolls the leading foot from the lateral side to the medial side and rolls the trailing foot from the medial side to the lateral side. During the downswing and follow-through, the trailing foot rolls from the lateral side to the medial side as the leading foot rolls from the medial side to the lateral side. Various outsole features described above, including traction elements and combinations of traction element types located in various regions, can advantageously (i) help stabilize the trailing foot at the top of the backswing and stabilize the leading foot during the downswing and follow-through, (ii) help stabilize the leading foot at the top of the backswing and stabilize the trailing foot during early portions of the downswing, and/or (iii) help arrest foot roll to the medial side. Flexure zones also facilitate the proper foot roll and increase comfort while the foot is rolling.

Although the swing is a critical part of golf play, a golfer may spend a large amount of time walking. In some cases, the golfer may be required to walk on potentially slippery surfaces (e.g., a wet grass, sand, slopes and hills, etc.). Ridge and fin traction elements provide propulsive traction to the wearer while walking. Spike traction elements may provide less propulsive traction than tab traction elements, but have a smaller cross section and allow easier penetration of a ground surface. Flexure zones permit natural flexing of the foot while walking and increase comfort.

One or more embodiments are directed to outsoles having a number of features, including flexure zones and traction elements that provide any of a number of benefits and advantages described herein. Those having skill in the art, with the knowledge gained from the present disclosure, will recognize that various changes can be made to these outsoles without departing from the scope of the present invention. For example, other embodiments include numerous additional variations on the embodiment of outsole 103. The number, placement and arrangement of fin traction elements, ridge traction elements, and spike traction elements, including circumferential spike traction elements, can be varied. In some embodiments, for example, ridge and/or spike traction elements are only included on the lateral or the medial side, which is divided by the second, lengthwise extending flexure zone. The configuration of ridge and fin traction elements could also be varied. As examples, ridge and/or fin fraction elements could have a serrated edge, can include intermediate bosses or studs embedded in a segment, etc. The shapes, arrangements and number of spike traction elements, including groups of circumferential spike traction elements, can also be varied. Other types of traction elements can be included. One or more flexure zones could be omitted.

The foregoing description of embodiments has been presented for purposes of illustration and description. The foregoing description is not intended to be exhaustive or to limit embodiments to the precise form explicitly described or mentioned herein. Modifications and variations are possible in light of the above teachings or may be acquired from practice of various embodiments. The embodiments described herein were chosen and described in order to explain the principles and the nature of various embodiments and their practical application to enable one skilled in the art to make and use these and other embodiments with various modifications as are suited to the particular use contemplated. Any and all permutations of features from above-described embodiments are the within the scope of the invention. References in the claims to characteristics of a physical element relative to a wearer of claimed article, or relative to an activity performable while the claimed article is worn, do not require actual wearing of the article or performance of the referenced activity in order to satisfy the claim.

The invention claimed is:

1. An article of footwear including a sole structure comprising an outsole, the outsole comprising:

a first flexure zone extending widthwise from a lateral side to a medial side of the outsole;

a second flexure zone intersecting the first flexure zone and extending lengthwise from at least a toe region to at least a midfoot region of the outsole; and intersecting hindfoot flexure zones that divide a hindfoot region into a forward lateral heel region, a forward medial heel region, a rear lateral heel region, and a rear medial heel region;

wherein the first and second flexure zones define, together with medial or lateral outer edges of the outsole, at least a lateral toe region, a medial toe region, a forward lateral forefoot region, and a forward medial forefoot region, wherein at least two of the lateral toe region, the medial toe region, the forward lateral forefoot region, and the forefoot medial forefoot region include a plurality of fin traction elements, wherein the article of footwear comprises adjacent, first and second side-extending fin traction elements extending beyond an outer edge of the outsole that defines a first same region selected from the group consisting of the lateral toe region, the medial toe region, the forward lateral forefoot region, the forward medial forefoot region, the forward lateral heel region, the forward medial heel region, the rear lateral heel region, the rear medial heel region, a rear lateral forefoot region, and a rear medial forefoot region, wherein the first and second side-extending fin traction elements protrude outwardly from an exposed medial or lateral side surface of the outsole, do not include the bottom of the outsole, and are configured to contact the ground only if the article of footwear is subjected to a lateral-medial rolling motion, and wherein the first and second side-extending fin traction elements each extend in a toe-heel length direction, the toe-heel length direction being their longest dimension, and wherein a central section of each of the first and second side-extending fin traction elements along said toe-heel length direction protrudes outward to a greater extent, relative to outer length sections of each of the first and second side-extending fin traction elements along said toe-heel length direction, from said exposed medial or lateral side surface of the outsole.

2. The article of footwear of claim 1, wherein the lateral toe region and the forward medial forefoot region comprise a plurality of fin traction elements.

3. The article of footwear of claim 1, wherein the first and second side-extending fin traction elements extend beyond an outer edge of the outsole that defines the forward medial forefoot region.

4. The article of footwear of claim 1, wherein the first side-extending fin traction element extends substantially horizontally when the article of footwear is in its upright position, and wherein the second side-extending fin traction element extends at an angle that is pitched downward from horizontal.

5. The article of footwear of claim 1, further comprising further side-extending fin traction elements that extend beyond an outer edge of the outsole that defines a second same region selected from the group consisting of the lateral toe region, the medial toe region, the forward lateral forefoot region, the forward medial forefoot region, the forward lateral heel region, the forward medial heel region, the rear lateral heel region, the rear medial heel region, the rear lateral forefoot region, and the rear medial forefoot region, wherein the second same region is different from the first same region.

6. The article of footwear of claim 1, wherein at least one region selected from the lateral toe region, the medial toe region, the forward lateral forefoot region, and the forward medial forefoot region, does not include a fin traction element.

7. The article of footwear of claim 6, wherein the medial toe region and the forward lateral forefoot region do not include a fin traction element.

8. The article of footwear of claim 6, wherein at least one region, which does not include a fin traction element, includes one or more of another type of traction element selected from a spike traction element, a ridge traction element, and combinations thereof.

9. The article of footwear of claim 8, wherein at least one region, which does not include a fin traction element, includes three or more circumferential spike traction elements.

10. The article of footwear of claim 9, wherein at least one of the plurality of circumferential spike traction elements extends to a height greater than all of the plurality of fin traction elements.

11. The article of footwear of claim 8, wherein the medial toe region and the forward lateral forefoot region each include at least three circumferential spike traction elements.

12. The article of footwear of claim 11, wherein the medial toe region and the forward lateral forefoot region further include a plurality of ridge traction elements.

13. The article of footwear of claim 8, wherein at least one region, which does not include a fin traction element, includes a plurality of ridge traction elements.

14. The article of footwear of claim 13, wherein at least two of the plurality of ridge traction elements are proximate a border of a region, wherein the border is defined by flexure zones.

15. The article of footwear of claim 1, wherein at least one of the lateral toe region, the medial toe region, the forward lateral forefoot region, and the forward medial forefoot region, which includes a plurality of fin traction elements, further includes a plurality of ridge traction elements.

16. The article of footwear of claim 15, wherein at least one of the plurality of ridge traction elements is proximate a border of a region, wherein the border is defined by flexure zones.

17. The article of footwear of claim 1, wherein the outsole further includes a third flexure zone extending widthwise from a lateral side to a medial side of the outsole and further from the toe edge, relative to the first flexure zone, wherein the third flexure zone intersects the second flexure zone but does not intersect the first flexure zone, wherein the first, second, and third flexure zones divide the outsole into a least the lateral toe region, the medial toe region, the forward lateral forefoot region, the forward medial forefoot region, the rear lateral forefoot region, and the rear medial forefoot region.

18. The article of footwear of claim 17, wherein the rear lateral forefoot region and the rear medial forefoot region include at least three circumferential spike traction elements.

19. The article of footwear of claim 1, wherein the rear lateral heel region and the rear medial heel region include a plurality of fin traction elements.

20. The article of footwear of claim 1, wherein the forward lateral heel region and the forward medial heel region include at least three circumferential spike traction elements.

21. The article of footwear of claim 1, wherein at least the first flexure zone extends entirely from the lateral side to the medial side of the outsole.

22. An article of footwear including a sole structure comprising an outsole, the outsole comprising:

a first flexure zone extending widthwise from a lateral side to a medial side of the outsole;

a second flexure zone intersecting the first flexure zone and extending lengthwise from at least a toe region to at least a midfoot region of the outsole;

a third flexure zone extending widthwise from a lateral side to a medial side of the outsole and further from the toe edge, relative to the first flexure zone, wherein the third flexure zone intersects the second flexure zone but does not intersect the first flexure zone, wherein the first, second, and third flexure zones divide the outsole into a lateral toe region, a medial toe region, a forward lateral forefoot region, a forward medial forefoot region, a rear lateral forefoot region, and a rear medial forefoot region; and intersecting hindfoot flexure zones that divide a hindfoot region into a forward lateral heel region, a forward medial heel region, a rear lateral heel region, and a rear medial heel region;

wherein the lateral toe region and the forward medial forefoot region comprise a plurality of fin traction elements and the medial toe region, the forward lateral forefoot region, the rear lateral forefoot region, and the rear medial forefoot region do not comprise fin traction elements, wherein both the rear lateral heel region and the rear medial heel region comprise a plurality of fin traction elements, and the forward lateral heel region and forward medial heel region do not comprise fin traction elements, wherein the article of footwear further comprises first and second side-extending fin traction elements extending beyond an outer edge of the outsole that defines a first same region selected from the group consisting of the lateral toe region, the medial toe region, the forward lateral forefoot region, the forward medial forefoot region, the rear lateral forefoot region, the rear medial forefoot region, the forward lateral heel region, the forward medial heel region, the rear lateral heel region, and the rear medial heel region, wherein the first and second side-extending fin traction elements protrude outwardly from an exposed medial or lateral side surface of the outsole, do not include the bottom of the outsole, and are configured to contact the ground only if the article of footwear is subjected to a lateral-medial rolling motion, and wherein the first and second side-extending fin traction elements each extend in a toe-heel length direction, the toe-heel length direction being their longest dimension, and wherein a central section of each of the first and second side-extending fin traction elements along said toe-heel length direction protrudes outward to a greater extent, relative to outer length sections of each of the first and second side-extending fin traction elements along said toe-heel length direction, from said exposed medial or lateral side surface of the outsole.

23. The article of footwear of claim 22, further comprising further side-extending fin traction elements that extend beyond an outer edge of the outsole that defines a second same region selected from the group consisting of the lateral toe region, the medial toe region, the forward lateral forefoot region, the forward medial forefoot region, the forward lateral heel region, the forward medial heel region, the rear lateral heel region, the rear medial heel region the rear lateral forefoot region, and the rear medial forefoot region, wherein the second same region is different from the first same region.

24. The article of footwear of claim 23, wherein the second same region is the forward lateral forefoot region.

25. The article of footwear of claim 1, wherein the longest dimension of the first and second side-extending fin traction elements is from about 5 mm (0.20 in) to about 20 mm (0.79 in).

26. The article of footwear of claim 22, wherein the longest dimension of the first and second side-extending fin traction elements is from about 5 mm (0.20 in) to about 20 mm (0.79 in).

27. The article of footwear of claim 3, wherein, other than the first and second side-extending fin traction elements, extending beyond an outer edge of the outsole that defines the forward medial forefoot region, no side-extending fin traction element extends beyond an outer edge of the outsole that defines a medial region of the outsole.

28. The article of footwear of claim 22, wherein the first and second side-extending fin traction elements extend beyond an outer edge of the outsole that defines the forward medial forefoot region, and wherein, other than the first and second side-extending fin traction elements, no side-extending fin traction element extends beyond an outer edge of the outsole that defines a medial region of the outsole.

* * * * *